US011484176B2

(12) United States Patent
Büsing et al.

(10) Patent No.: US 11,484,176 B2
(45) Date of Patent: Nov. 1, 2022

(54) DISHWASHER

(71) Applicant: SAMSUNG ELECTRONICS CO., LTD., Suwon-si (KR)

(72) Inventors: Johannes Büsing, Suwon-si (KR); Ji Sun Yang, Suwon-si (KR); Seung Wan Yoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 313 days.

(21) Appl. No.: 16/712,099

(22) Filed: Dec. 12, 2019

(65) Prior Publication Data

US 2020/0187746 A1 Jun. 18, 2020

(30) Foreign Application Priority Data

Dec. 12, 2018 (KR) ..... 10-2018-0160324

(51) Int. Cl.

| | |
|---|---|
| ***A47L 15/16*** | (2006.01) |
| ***A47L 15/22*** | (2006.01) |
| ***A47L 15/23*** | (2006.01) |
| ***A47L 15/42*** | (2006.01) |

(52) U.S. Cl.

CPC ..... *A47L 15/16* (2013.01); *A47L 15/22* (2013.01); *A47L 15/23* (2013.01); *A47L 15/421* (2013.01); *A47L 15/4214* (2013.01); *A47L 15/4217* (2013.01); *A47L 15/4219* (2013.01)

(58) Field of Classification Search

None

See application file for complete search history.

(56) References Cited

U.S. PATENT DOCUMENTS

| | | | |
|---|---|---|---|
| 2005/0081897 | A1 | 4/2005 | Pardini |
| 2008/0023095 | A1 | 1/2008 | Burrows et al. |

FOREIGN PATENT DOCUMENTS

| | | | |
|---|---|---|---|
| EP | 2 441 370 | A2 | 4/2012 |
| EP | 3 040 011 | A1 | 7/2016 |
| JP | 11-342098 | | 12/1999 |
| JP | 2000-33067 | | 2/2000 |
| JP | 2002315713 | A | 10/2002 |
| KR | 10-0786069 | | 12/2007 |
| KR | 10-2008-0094018 | | 10/2008 |
| KR | 10-1142165 | | 5/2012 |
| KR | 10-2017-0138791 | | 12/2017 |

OTHER PUBLICATIONS

Extended European Search Report dated Feb. 25, 2020 from European Application No. 19215641.2, 8 pages.

International Search Report dated Apr. 16, 2020 from International Application No. PCT/KR2019/017585, 3 pages.

*Primary Examiner* — Levon J Shahinian

(74) *Attorney, Agent, or Firm* — Staas & Halsey LLP

(57) ABSTRACT

Disclosed herein is a dishwasher. The dishwasher includes a main body, a tub provided inside the main body, a basket provided inside the tub to store items, an injection assembly configured to spray water to wash the item in the basket, and a duct including a first body configured to supply water to the injection assembly and provided to extend along a first direction, and a second body to which water flows and provided to extend from the first body to along second direction. The duct is formed by coupling of a first housing provided to form at least a portion of the first body and the second body, and a second housing provided to form another portion of the first body and the second body.

19 Claims, 14 Drawing Sheets

DISHWASHER

CROSS-REFERENCE TO RELATED APPLICATION(S)

This application is based on and claims priority under 35 U.S.C. § 119 to Korean Patent Application No. 10-2018-0160324, filed on Dec. 12, 2018, in the Korean Intellectual Property Office, the disclosure of which is incorporated by reference herein in its entirety

BACKGROUND

1. Field

The disclosure relates to a dishwasher, more particularly to a dishwasher including a duct having an improved structure.

2. Description of Related Art

A dishwasher is a device that automatically cleans food residues on dishes using detergent and wash water.

The dishwasher includes a main body, a tub disposed inside the body, a storage container disposed inside the tub to accommodate dishes, and an injection unit provided to spray wash water into the storage container.

The storage container is usually provided in two or three stages, and a plurality of injection units may be configured to spray the wash water to a place where each storage container is positioned and arranged in accordance with the storage container.

The dishwasher includes a duct, through which the wash water flows, to provide wash water to the plurality of injection units.

The duct may extend in the vertical direction to supply the wash water to the storage container provided in two to three stages, and may also extend in the front-rear direction to receive the wash water. Thus, the duct has a shape extending in at least two directions. As a result, the manufacturing process of the duct may be complicated.

SUMMARY

Therefore, it is an aspect of the disclosure to provide a dishwasher including an improved structure capable of easily forming a shape of a duct using a method, in which a plurality of components is coupled to each other, without using a blow molding method.

It is another aspect of the disclosure to provide a dishwasher capable of easily forming a duct using a method in which a plurality of components is coupled to each other.

Additional aspects of the disclosure will be set forth in part in the description which follows and, in part, will be obvious from the description, or may be learned by practice of the disclosure.

In accordance with an aspect of the disclosure, a dishwasher includes a main body, a tub provided inside the main body, a basket provided inside the tub to store dishes, an injection unit (assembly) configured to spray wash water to wash dishes in the basket, and a duct including a first body configured to supply wash water to the injection unit and provided to extend in a first direction, and a second body to which wash water flows and provided to extend from the first body to a second direction. The duct is formed by coupling of a first housing provided to form at least a portion of the first body and the second body, and a second housing provided to form another portion of the first body and the second body.

The duct may include a flow path provided inside the first body and the second body and having a width in a third direction, the first housing may extend in the third direction to form at least a portion of the flow path, and the second housing may extend in the third direction to form another portion of the flow path.

The first housing may include a first sealing surface tightly coupled to the second housing, and the second housing may include a second sealing surface in contact with the first sealing surface, and the first sealing surface and the second sealing surface may be provided in the first body to face each other in the second direction while being provided in the second body to face each other in the third direction perpendicular to the first direction, and end portions of the first sealing surface and the second sealing surface may be provided in a closed loop shape with respect to the second direction, respectively.

The first housing and the second housing may be hooked to each other in the first direction.

The first housing may further include a hook arranged on the outside of the first sealing surface and configured to be hooked to the second housing.

The second housing may further include a hook groove arranged on the outside of the second sealing surface and configured to be engaged with the hook.

The first housing may further include a first curved surface arranged in the second body so as to guide wash water to the first body.

The second housing may further include a second curved surface arranged in the second body so as to guide wash water to the first body.

The second housing may include an inlet configured to allow wash water to flow to the inside of the duct.

The first housing may include an outlet configured to supply wash water to the injection unit.

The injection unit may include an intermediate rotor arranged on a center of the inside of the tub and an upper rotor arranged on an upper portion of the inside of the tub, the outlet may be connected to the intermediate rotor, and the second housing may include an auxiliary outlet configured to supply wash water to the upper rotor.

The duct may further include an upper duct configured to connect the auxiliary outlet and the upper rotor.

The first housing may further include a guide provided to protrude in the first direction to guide coupling of the intermediate rotor and the outlet.

The outlet and the guide may be integrally formed with the first housing.

The first body may further include a bent portion configured to allow the duct to be bent in the third direction perpendicular to the second direction.

In accordance with another aspect of the disclosure, a dishwasher includes a main body, a tub provided inside the main body, a basket provided inside the tub to store dishes, an injection unit configured to spray wash water to wash dishes in the basket, and a duct formed by coupling of a first housing and a second housing and configured to supply wash water to the injection unit. The first housing includes an outlet configured to supply wash water to the injection unit, and the second housing includes an inlet configured to allow wash water to flow to the inside of the duct.

The first housing and the second housing may be hooked to each other.

The duct may further include a first body provided to extend in a first direction, a second body provided to extend from the first body to a second direction, and a flow path having a width in a third direction perpendicular to the first direction and the second direction, and the first housing may be formed in the first direction, the second direction and the third direction to form at least a portion of the first body, the second body, and the flow path, and the second housing may be formed in the first direction, the second direction and the third direction to form another portion of the first body, the second body, and the flow path.

The second housing may include a coupling protrusion provided to protrude in a closed loop shape to seal the flow path, and the first housing may include a coupling portion to which the coupling protrusion is inserted, and an inner surface of the coupling protrusion may include a first sealing surface in contact with the coupling portion, and the coupling portion may include a second sealing surface in contact with the first sealing surface to seal the flow path.

In accordance with another aspect of the disclosure, a duct includes an outlet configured to supply wash water to an injection unit configured to spray wash water, an inlet to which wash water flows, a first housing in which the outlet is arranged, and provided to extend in at least three directions perpendicular to each other, and a second housing in which the inlet is arranged and configured to be coupled to the first housing.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
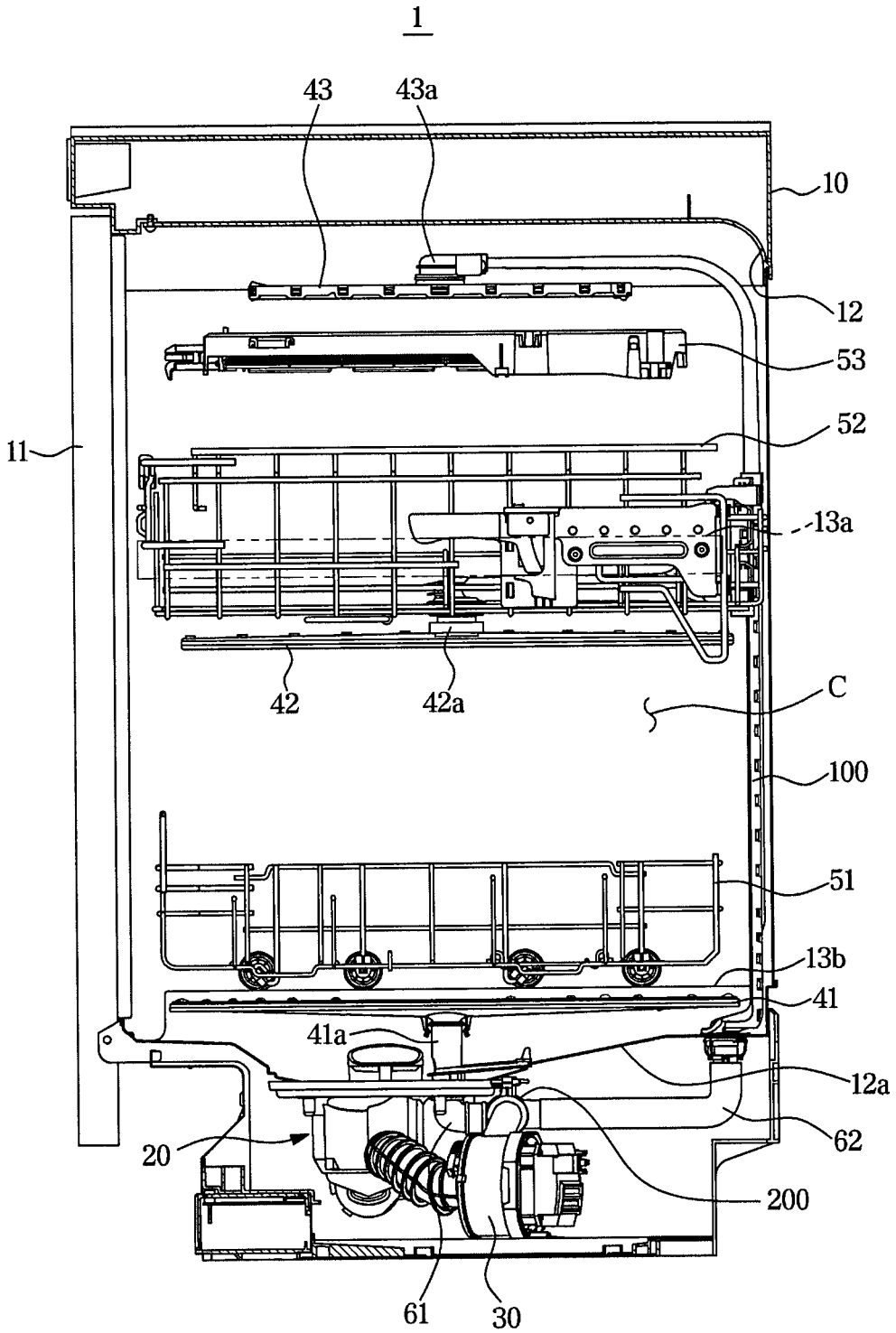
FIG. 1 is a cross-sectional view of a dishwasher according to an embodiment of the disclosure.

Hereinafter embodiments of the disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

Hereinafter dishes may be used as a concept encompassing a bowl, a cup, a cutlery, and various cooking utensils.

A first direction D1 to be described below refers to the up-down direction, which is the height direction of a dishwasher 1, a second direction D2 refers to the front-rear direction of the dishwasher 1, and the third direction D3 refers to the left and right direction of the dishwasher 1.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Figure 2:
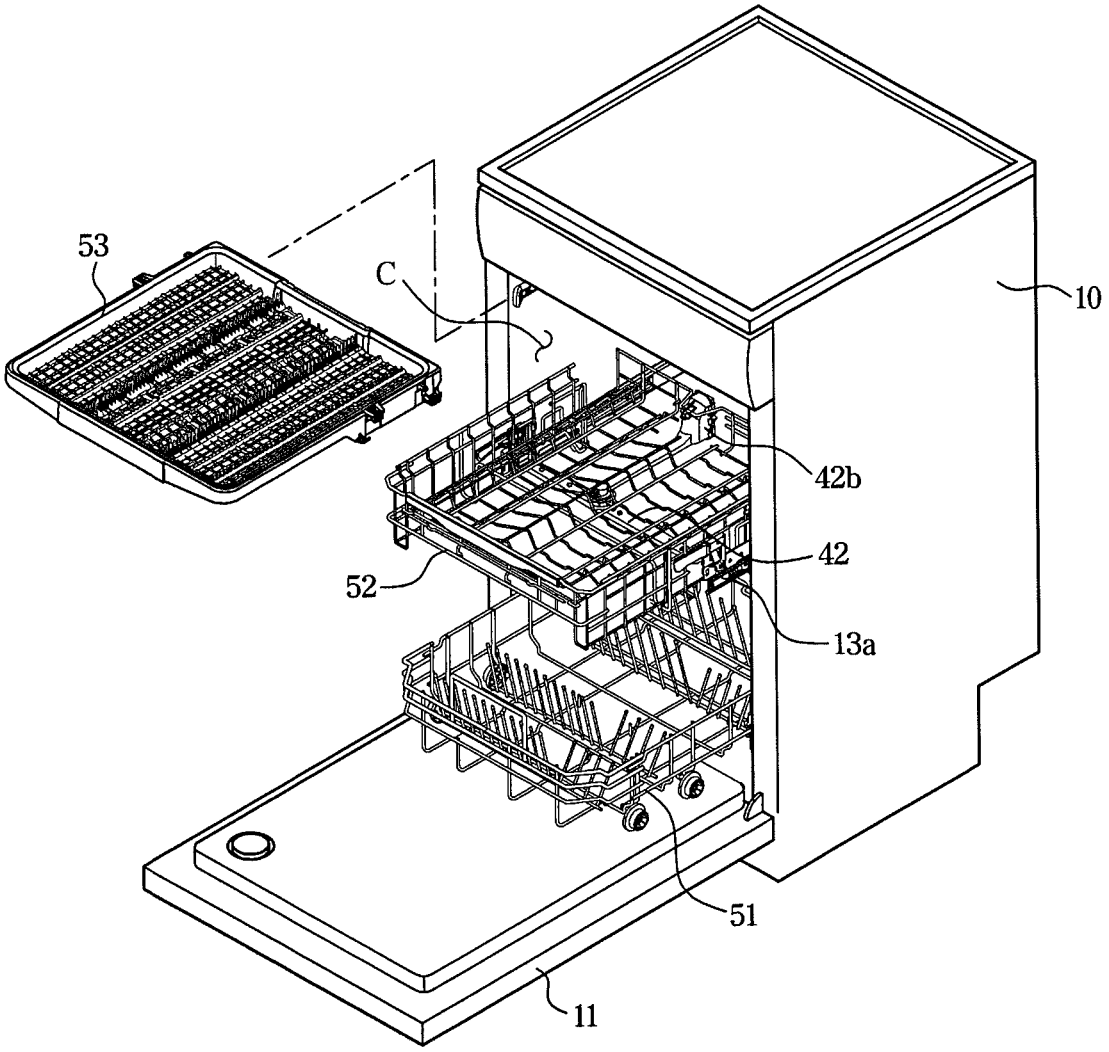
FIG. 2 is a perspective view of the dishwasher according to an embodiment of the disclosure.

FIG. 1 is a cross-sectional view of a dishwasher according to an embodiment of the disclosure and FIG. 2 is a perspective view of the dishwasher according to an embodiment of the disclosure.

As illustrated in FIGS. 1 and 2, the dishwasher 1 may include a main body 10 forming an appearance.

The dishwasher 1 may further include a tub 12 provided inside the main body 10. The tub 12 may be provided in a substantially box shape. One side of the tub 12 may be open. That is, the tub 12 may have an opening. As an example, a front surface of the tub 12 may be open.

The dishwasher 1 may further include a door 11 configured to open and close the opening of the tub 12. The door 11 may be installed in the main body 10 to open and close the opening of the tub 12. The door 11 may be installed in the main body 10 to be rotatable.

The dishwasher 1 may further include a storage container provided in the tub 12 to accommodate dishes.

The storage container may include a plurality of baskets 51, 52 and 53. Relatively large dishes may be stored in the plurality of baskets 51 and 52. However, the kind of dishes accommodated in the plurality of baskets 51, 52, and 53 is not limited to relatively large dishes. That is, the plurality of baskets 51, 52 and 53 may accommodate not only relatively large dishes but also relatively small dishes.

The plurality of baskets 51, 52, and 53 may include an intermediate basket 52 positioned in the middle of the height of the dishwasher 1, and a lower basket 51 positioned in a lower portion in the height direction of the dishwasher 1. The intermediate basket 52 may be provided to be supported by an intermediate guide rack 13*a*, and the lower basket 51 may be provided to be supported by a lower guide rack 13*b*. The intermediate guide rack 13*a* and the lower guide rack 13*b* may be installed on an inner wall 14 of the tub 12 so as to be slidable toward the opening of the tub 12. The inner wall 14 of the tub 12 may include an inner surface of a right wall and an inner surface of a left wall of the tub 12.

The storage container may include an upper basket 53 positioned in an upper portion of the height of the dishwasher 1. The upper basket 53 may be formed in a rack assembly to accommodate relatively small tableware. It is appropriate that the upper basket 53 may contain a cooking utensil such as a ladle, a knife, or a turner, or cutlery. In addition, the rack assembly may accommodate a small cup such as an espresso cup. However, the kind of dishes accommodated in the upper basket 53 is not limited to the above example.

In addition, the configuration of the baskets is not limited thereto, and thus according to the size of the tub 12, the upper basket 53 may not be included. Therefore, the storage container may be implemented only with the intermediate basket 52 and the lower basket 51.

The dishwasher 1 may further include a sump 20 configured to collect and store the wash water. The dishwasher 1 may include a washing chamber C corresponding to a space formed by the inside of the tub 12.

The washing chamber C is a space in which the dishes placed in the baskets 51, 52, and 53 are washed by the wash water and then dried. The wash water circulated in the washing chamber C and the sump 20 may be sealed to prevent that the wash water is leaked to the outside of the washing chamber C through a component except for the sump 20.

The dishwasher 1 may further include injection units 41, 42, and 43 configured to spray wash water. The injection units 41, 42, and 43 may include a first injection unit 41 disposed below the lower basket 51 in the height direction of the dishwasher 1, a second injection unit 42 disposed below the intermediate basket 52 in the height direction of the dishwasher 1, and a third injection unit 43 disposed above the upper basket 53 in the height direction of the dishwasher 1.

The first injection unit 41 may be rotatable about a rotating shaft 41*a*, the second injection unit 42 may be rotatable about a rotating shaft 42*a*, and the third injection unit 43 may be rotatable about a rotating shaft 43*a*.

However, the position of the injection unit is not limited thereto, and thus the first injection unit 41 may be fixed to one side of the lower portion of the washing chamber C unlike the second injection unit 42 and the third injection unit 43. In this case, the first injection unit 41 may be configured to spray water in a substantially horizontal direction by a fixed nozzle, and the wash water sprayed in the horizontal direction from the nozzle of the first injection unit 41 may be directed to the upper side because a direction of the sprayed water is changed by a switching assembly. The switching assembly may be installed on a rail by a holder and translated along the rail.

The third injection unit 43 may spray the wash water toward the dishes stored in the upper basket 53 and the intermediate and lower baskets 52 and 51, and the second injection unit 42 may spray the wash water toward the dishes stored in the intermediate basket 52 and the upper basket 53.

Unlike the second injection unit 42 and the third injection unit 43, the first injection unit 41 may be fixed to the lower side of the tub 12, particularly to the inside of the sump 20.

The dishwasher 1 may include a circulation pump 30 configured to pump water stored in the sump 20 toward the injection units 41, 42, and 43. The wash water pumped by the circulation pump 30 may be supplied to the first injection unit 41 through an alternating device 200 connected with the circulation pump 30. Alternatively, the wash water pumped by the circulation pump 30 may be moved upward by a duct 100 to be described later and then supplied to the second injection unit 42 or the third injection unit 43.

As described above, the wash water stored in the sump 20 or wash water introduced into the dishwasher 1 from the outside may flow to the alternating device 200 by the circulation pump 30.

The alternating device 200 may provide the wash water to the first injection unit 41 through a first flow path 61 connected to the first injection unit 41, and may provide the wash water to the duct 100 through a second flow path 62 connected to the duct 100.

The alternating device 200 may selectively provide the wash water to at least one of the first injection unit 41 and the duct 100.

The first flow path 61 and the second flow path 62 may be arranged below the washing chamber C. The wash water may flow into the first injection unit 41 and the duct 100 disposed in the washing chamber C through the first flow path 61 and the second flow path 62.

The wash water may flow into the second injection unit 42 and the third injection unit 43 through the duct 100. (The first injection unit, the second injection unit, and the third injection unit of the injection unit may be referred to as a first rotor, a second rotor, and a third rotor of the injection unit, respectively. However, hereafter the injection unit will be referred to as the first injection unit, the second injection unit, and the third injection unit. In addition, the names of the injection unit are not limited thereto, and conversely, the injection units may be referred to as the first injection unit, the second injection unit, and the first injection unit in order from the upper side)

Hereinafter the duct 100 will be described in detail.

Figure 3:
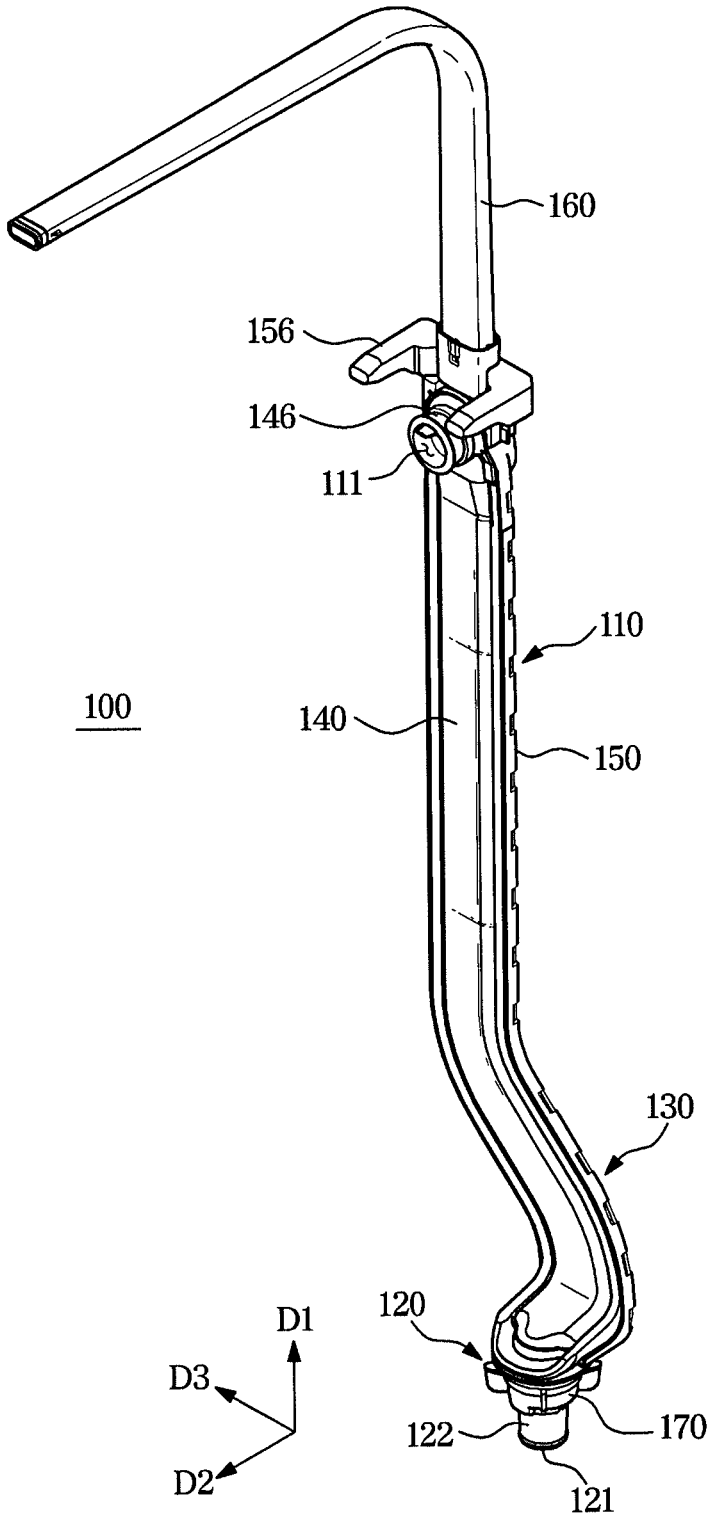
FIG. 3 is a perspective view of a duct of the dishwasher according to an embodiment of the disclosure.
Figure 4:
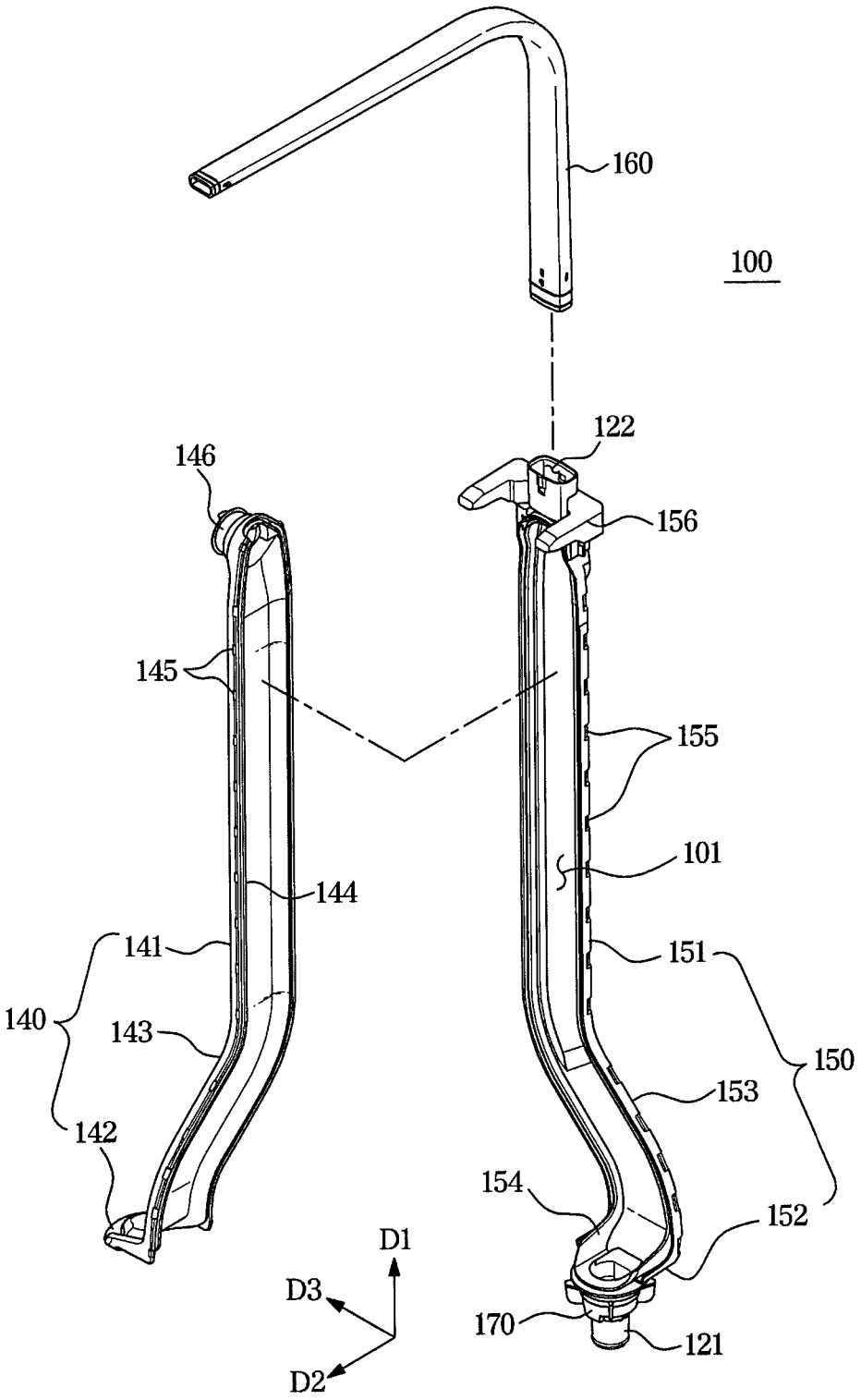
FIG. 4 is an exploded perspective view of the duct of the dishwasher according to an embodiment of the disclosure.
Figure 5:
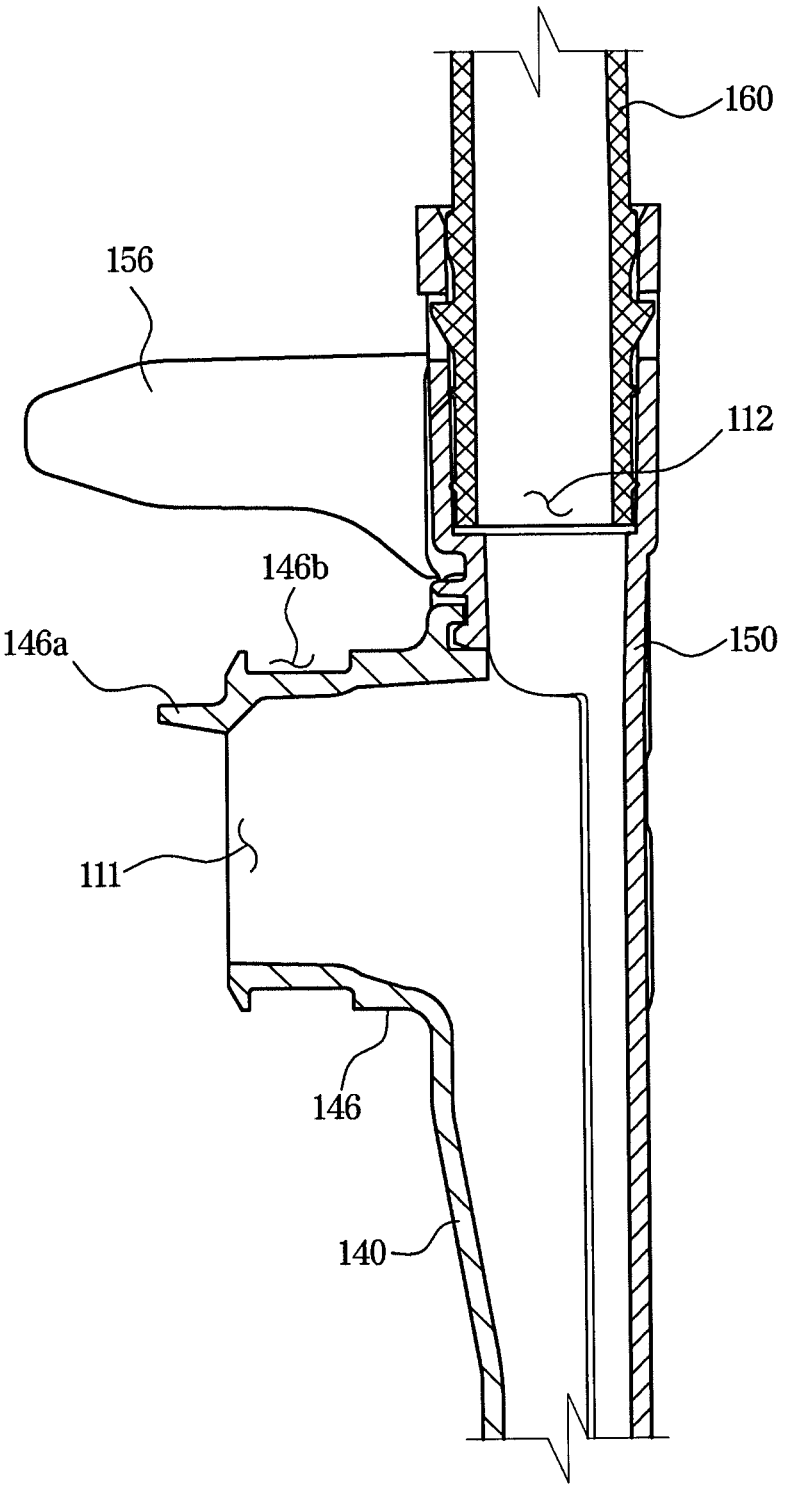
FIG. 5 is a cross-sectional view of a part of the duct of the dishwasher according to an embodiment of the disclosure.
Figure 6:
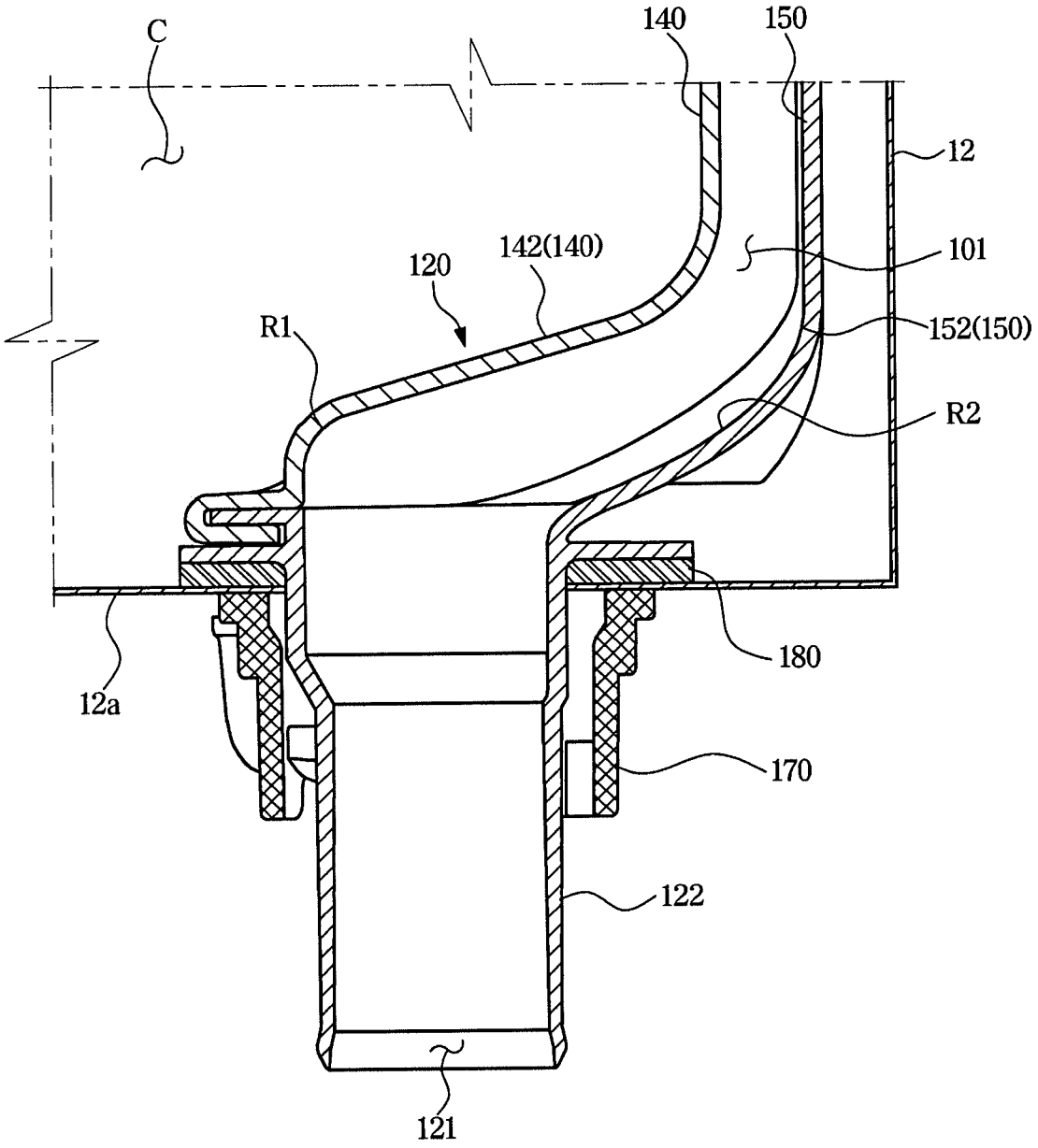
FIG. 6 is a perspective view of an intermediate rotor and an intermediate basket of the dishwasher according to an embodiment of the disclosure.
Figure 7:
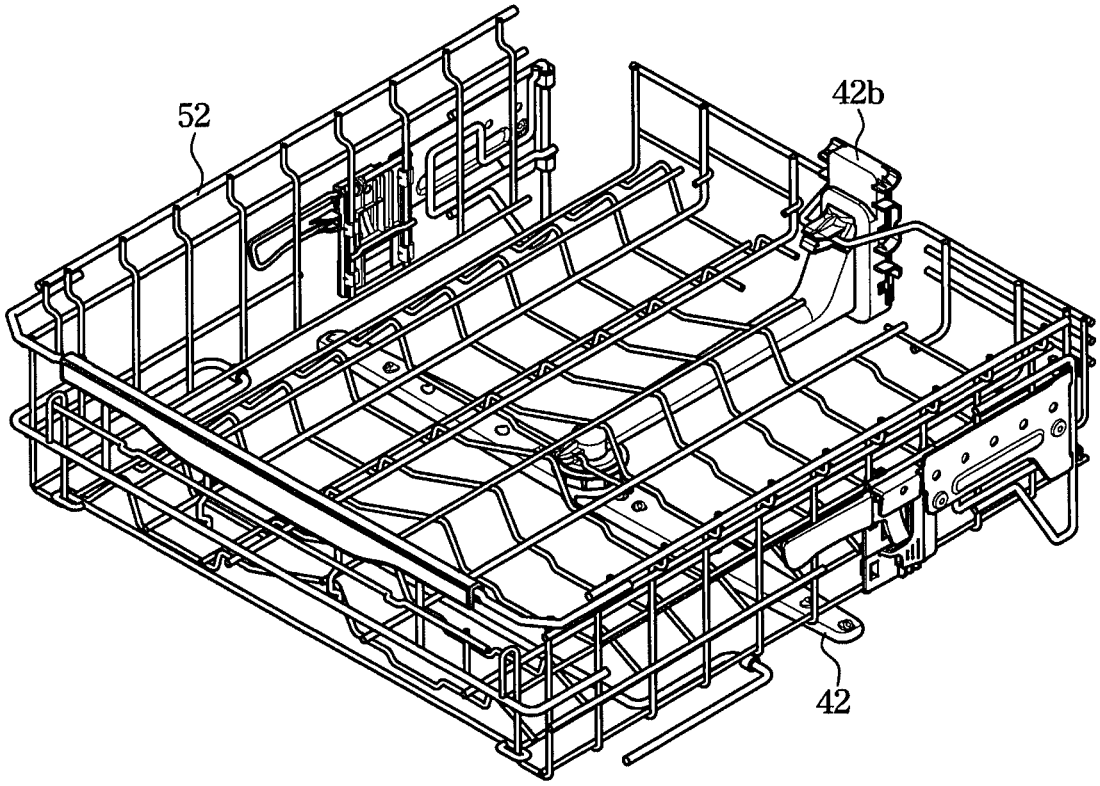
FIG. 7 is a rear perspective view of the intermediate rotor of the dishwasher according to an embodiment of the disclosure.
Figure 8:
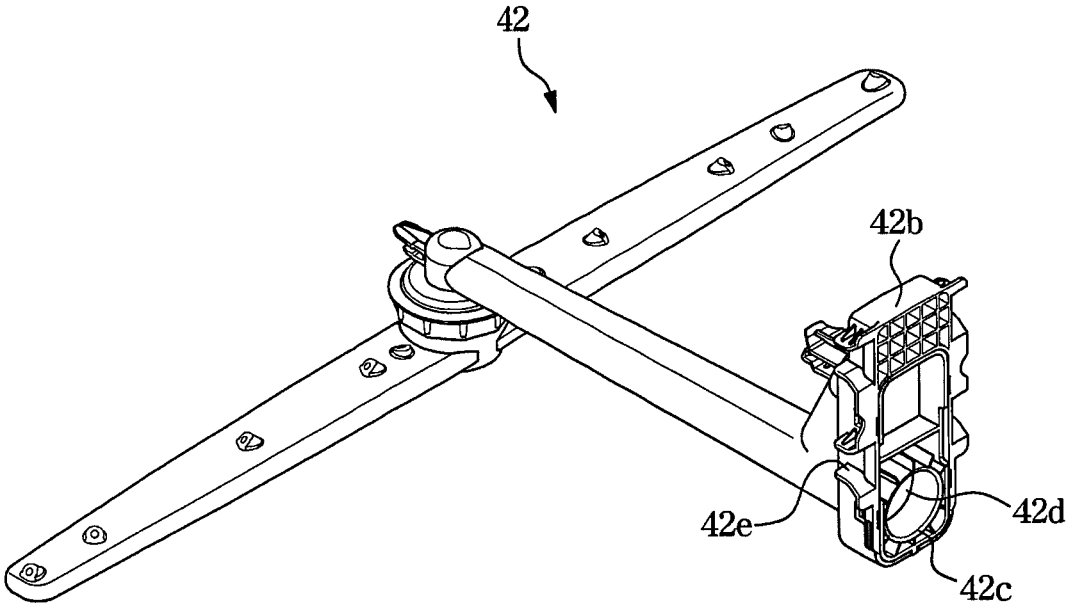
FIG. 8 is a cross-sectional view of the intermediate rotor and the intermediate basket of the dishwasher according to an embodiment of the disclosure.
Figure 9:
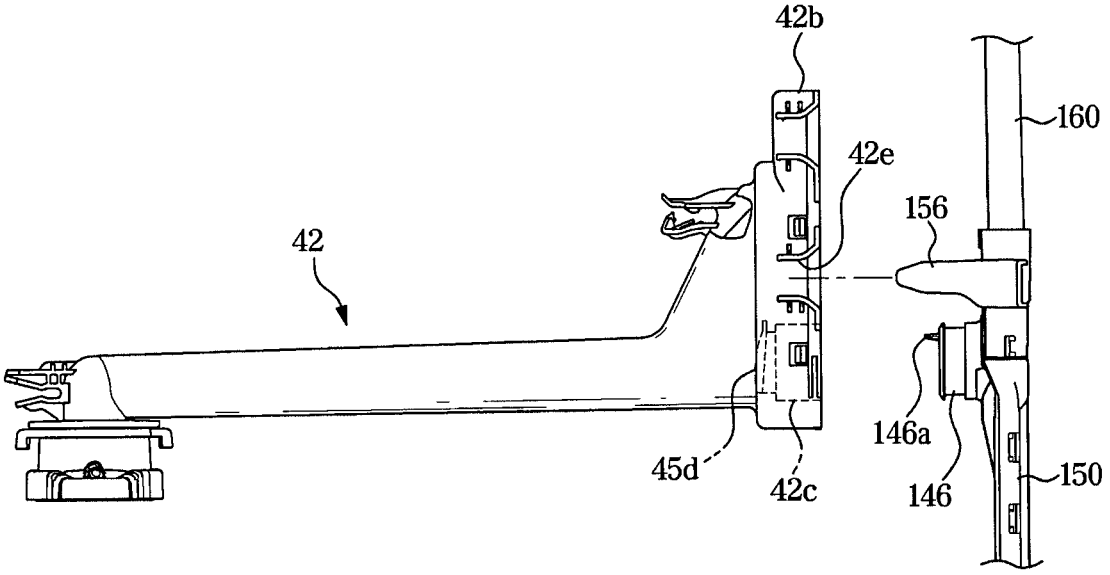
FIG. 9 is a cross-sectional view of a part of the duct of the dishwasher according to an embodiment of the disclosure.
Figure 10:
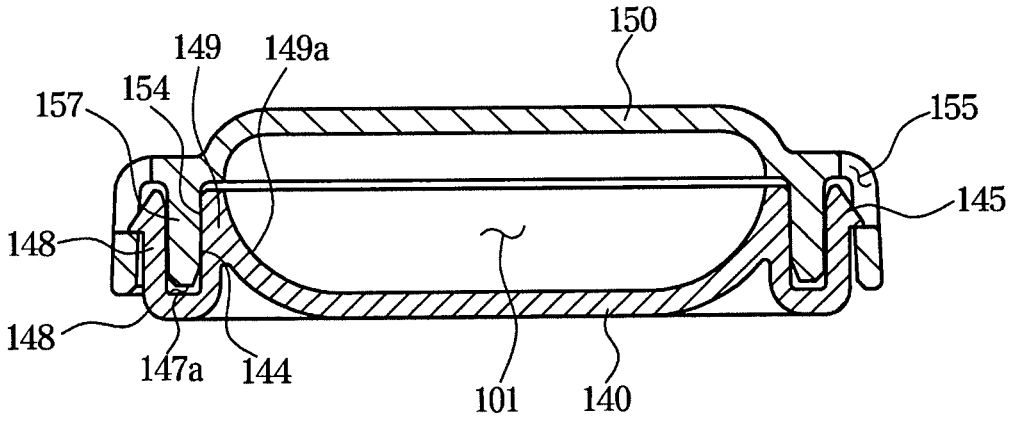
FIG. 10 is a sectional view of the duct of the dishwasher according to an embodiment of the disclosure.
Figure 11:
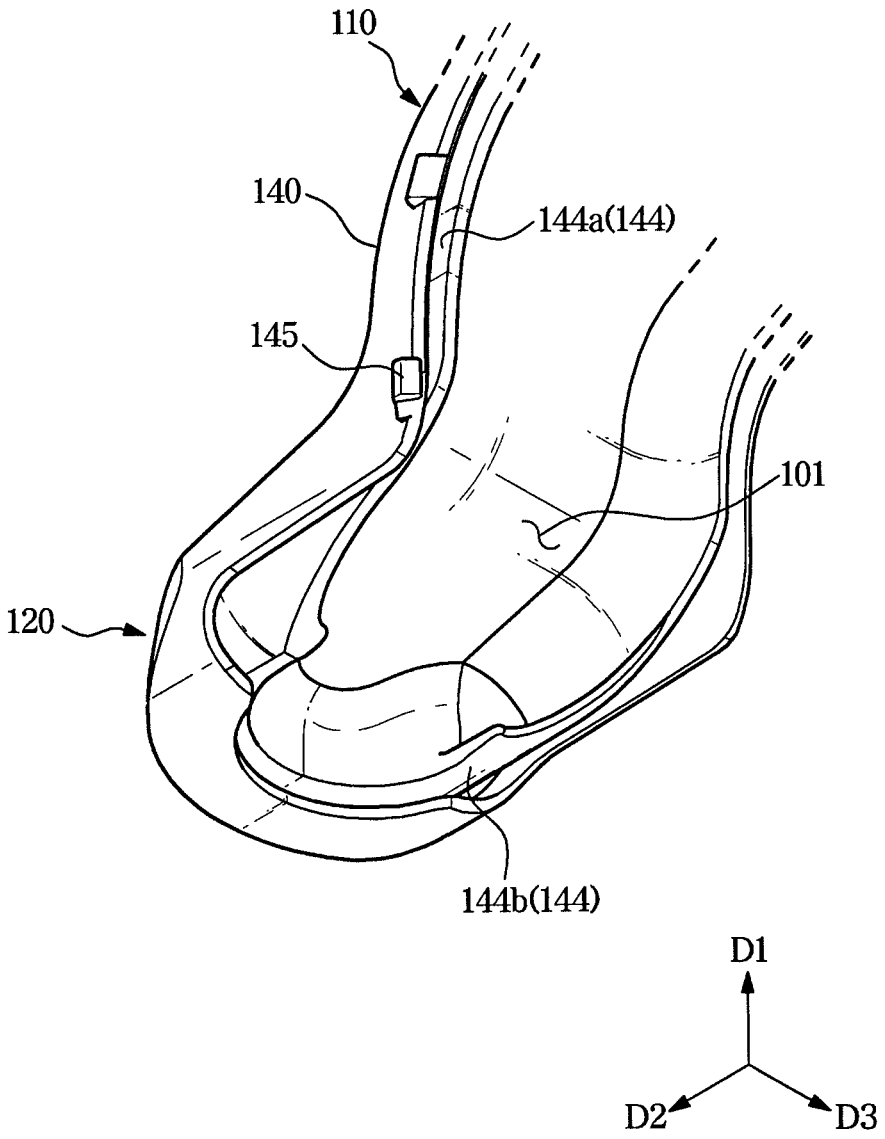
FIG. 11 is a rear perspective view of a part of a first housing of the duct of the dishwasher according to an embodiment of the disclosure.
Figure 12:
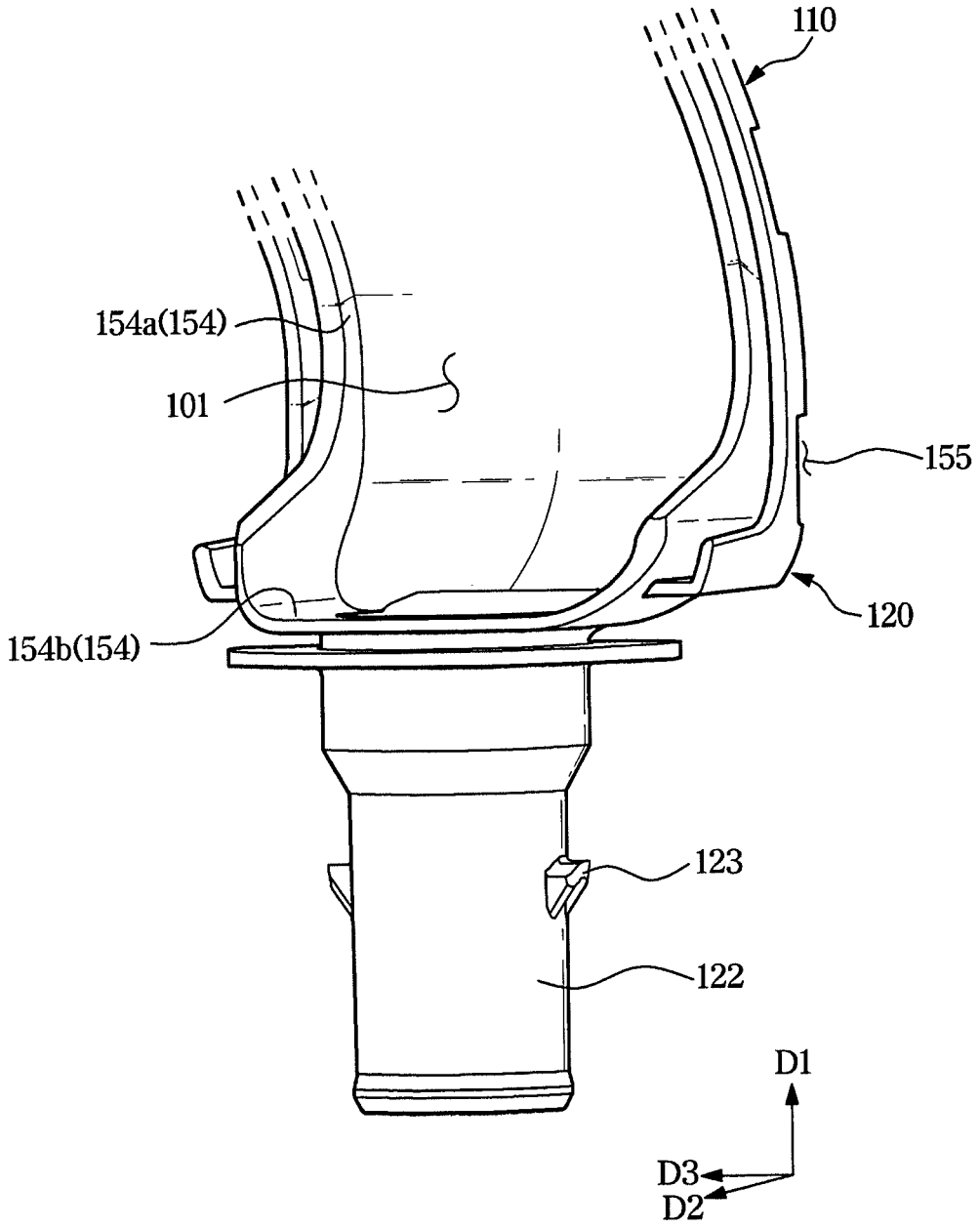
FIG. 12 is a front perspective view of a part of the first housing of the duct of the dishwasher according to an embodiment of the disclosure.

FIG. 3 is a perspective view of a duct of the dishwasher according to an embodiment of the disclosure, FIG. 4 is an exploded perspective view of the duct of the dishwasher according to an embodiment of the disclosure, FIG. 5 is a cross-sectional view of a part of the duct of the dishwasher according to an embodiment of the disclosure, FIG. 6 is a perspective view of an intermediate rotor and an intermediate basket of the dishwasher according to an embodiment of the disclosure, FIG. 7 is a rear perspective view of the intermediate rotor of the dishwasher according to an embodiment of the disclosure, FIG. 8 is a cross-sectional view of the intermediate rotor and the intermediate basket of the dishwasher according to an embodiment of the disclosure, FIG. 9 is a cross-sectional view of a part of the duct of the dishwasher according to an embodiment of the disclosure, FIG. 10 is a sectional view of the duct of the dishwasher according to an embodiment of the disclosure, FIG. 11 is a rear perspective view of a part of a first housing of the duct of the dishwasher according to an embodiment of the disclosure, and FIG. 12 is a front perspective view of a part of the first housing of the duct of the dishwasher according to an embodiment of the disclosure.

As described above, as for a first body 110 and a second body 120, the number such as "first" and "second" do not limit a component and thus a component corresponding to the first body 110 and a component corresponding to the second body 120 may be referred to as the second body 120 and the first body 110, respectively.

Further, as for a first housing 140 and a second housing 150, the number such as "first" and "second" do not limit a component and thus a component corresponding to the first housing 140 and a component corresponding to the second housing 150 may be referred to as the second housing 140 and the first housing 150, respectively.

As illustrated in FIGS. 3 and 4, the duct 100 may include a first body 110 extending in a first direction D1 facing upward in the height direction of the dishwasher 1 (the first body 110 may be referred to as an extension but hereinafter it is referred to as the first body). The wash water pumped from the circulation pump 30 disposed below the washing chamber C may be moved upward through the first body 110 to flow to the second injection unit 52 or the third injection unit 53.

The first body 110 may include a first outlet hole 111 provided to discharge the wash water moving upward along the first body 110.

The wash water discharged through the first outlet hole 111 may be moved to the second injection unit 42.

The duct 100 may include a second body 120 to which the wash water flows and which extends in a second direction D2 in the front-rear direction of the dishwasher 1 with respect to the first direction D1 (the second body 120 may be referred to as an inlet portion but hereinafter it is referred to as the second body 120).

The second body 120 may include an inlet dock 122 extending to the lower side of the washing chamber C by passing through the lower surface 12*a* of the tub 12 and configured to allow the duct to be supported by the lower surface 12*a* of the tub 12, and an inlet hole 121 arranged in a lower end of the inlet dock 122 and to which the wash water flows.

The inlet dock 122 may introduce the wash water into the second body 120 through the inlet hole 121 while supporting the duct 100 against the tub 12.

The wash water introduced through the inlet hole 121 may be moved to the inside of the duct 100 through a duct flow path 101 formed in the second body 120 and the first body 110, and then discharged to the first outlet hole 111.

The duct flow path 101 may be defined as a space arranged inside the duct 100 along the first body 110 and the second body 120 and the space in which the wash water flows. The duct flow path 101 may have a width extending in a third direction D3 perpendicular to the first direction D1 and the second direction D2.

The first body 110 may include a second outlet hole 112 provided to discharge the wash water flowing upward along the first body 110

The wash water discharged through the second outlet hole 112 may be moved to the third injection unit 43. That is, the wash water flowing through the first body 110 may be discharged to the second injection unit 42 or the third injection unit 43 through the first outlet hole 111 or the second outlet hole 112.

The duct 100 may include an upper duct 160 connecting the third injection unit 43 to the second outlet hole 112. The upper duct 160 may be provided to communicate with the second outlet hole 112.

Particularly, a lower end of the upper duct 160 may be inserted into the second outlet hole 112 to be interlocked with the second outlet hole 112. However, the configuration is not limited thereto, and thus the second outlet hole 112 may be inserted into the lower end of the upper duct 160.

The configuration is not limited to an embodiment of the disclosure. Therefore, the upper duct 160 may be provided as two components and integrally formed with a first housing 140 and a second housing 150 described later.

In the conventional manner, when the duct includes a portion extending in the first direction, the second direction, and the third direction as illustrated in an embodiment of the disclosure, that is, when the duct is formed in the three dimension directions, the duct may be manufactured through the blow molding method.

According to an embodiment of the disclosure, the first body 110 may extend in the first direction D1 while the second body 120 may extend in the second direction D2 with respect to the first body 110. Further, the first and second bodies 110 and 120 may extend in the third direction D3 to form the duct flow path 101.

When the duct is manufactured by the blow molding method, the manufacturing time is relatively long, and the duct is formed through a relatively large number of manufacturing steps, which is inefficient.

Particularly, when a duct is manufactured by the blow molding method, a tube extrusion process, a L-bending process or U-bending process for forming the duct in the three dimensional directions, a process of forming the shape through the molding, and a process of cutting an unnecessary part may be required.

As the shape of the duct becomes more complex, the number of manufacturing steps may increase and complicated, thereby decreasing the manufacturing efficiency. Particularly, when a traveling direction of the flow path formed inside the duct is changed, the process of bending the duct may be increased, thereby lowering the manufacturing efficiency.

Further, in order to form the first outlet hole 111 in the duct, and to additionally form a docking portion 146 removably coupled to the second injection unit 42 or a guide 156 configured to guide the second injection unit 42 to be coupled to the docking portion 146, an additional manufacturing step may be required to form those or alternatively, it is required to additionally form the docking portion 146 and the guide 156 and then to couple the docking portion 146 and the guide 156 to the duct because it is difficult to implement the detailed shape of the duct using the blow molding method, thereby lowering the manufacturing efficiency.

In order to ease such a difficulty, the duct 100 according to an embodiment of the disclosure may be formed as the first housing 140 is coupled to the second housing 150.

Accordingly, without the blow molding method, the duct 100 may be manufactured by coupling of the first housing 140 and the second housing 150, which are injected into a shape as needed.

Because the first housing 140 and the second housing 150 are respectively injected and then easily coupled to each other so as to manufacture the duct 100, the manufacturing step may be reduced and the manufacturing time may be also reduced, thereby improving the productivity.

Even in the conventional manner, the duct may be formed through a manufacturing method in which two components are thermally bonded. However, in the case of the thermal bonding manufacturing method, the manufacturing method is possible only when the duct extends in one direction. Therefore, when the duct is required to extend in at least three directions such as the first direction D1, the second direction D2, and the third direction D3, as illustrated in the embodiment of the disclosure, it is impossible to apply the thermal bonding method for manufacturing the duct.

In order to ease each the above difficulty, as for the duct 100 according to an embodiment of the disclosure, the first housing 140 and the second housing 150 may be hooked to each other and thus even when the duct 100 has a shape extending in at least three directions D1, D2, and D3, it is possible to form the duct 100 only using two components (the first housing and the second housing).

Particularly, the first housing 140 may include a hook 145 hooked to the second housing 150, and the second housing 150 may include a hook groove 155 with which the hook 145 is engaged.

The first housing 140 may include a first region 141 of the first housing 140 corresponding to the first body 110, and a second region 142 of the first housing 140 corresponding to the second body 120.

The second housing 150 may include a first region 151 of the second housing 150 corresponding to the first body 110, and a second region 152 of the second housing 150 corresponding to the second body 120.

The first region 141 of the first housing 140 and the first region 151 of the second housing 150 may be arranged at positions facing each other and engaged by the engagement of the hook 145 and the hook groove 155.

The second region 142 of the first housing 140 and the second region 152 of the second housing 150 may be arranged at positions facing each other and engaged by the engagement of the hook 145 and the hook groove 155.

The duct 100 may include a bent portion 130 provided on the first body 110 and extending in the third direction D3 (the bent portion 130 may also be referred to as a third body, but hereinafter it is referred to as a bent portion).

The bent portion 130 is a portion that is bent in the direction, in which the first body 110 extends, so as not to limit the rotation of the first injection unit 41.

That is, as described above, when the first injection unit 41 sprays wash water through a rotation thereof, the duct 100 may limit the rotation of the first injection unit 41 according to the size of the inside of the washing chamber C.

The duct 100 may be arranged radially outward of the first injection unit 41 through the bent portion 130, and thus the duct 100 may not limit the rotation of the first injection unit 41. Therefore, it is possible to efficiently use the inside of the washing chamber C.

The first housing 140 may include a third region 143 of the first housing 140 corresponding to the bent portion 130.

The second housing 150 may include a third region 153 of the second housing 150 corresponding to the bent portion 130.

The third direction D3 may be defined as a direction perpendicular to the first direction D1 or the second direction D2. The bent portion 130 may extend perpendicularly to the first body 110 or the second body 120 in a direction corresponding to the third direction D3. According to an embodiment of the disclosure, the bent portion 130 may extend to be inclined relative to the third direction D3.

As mentioned above, the bent portion 130 may be formed on any one part of the first body 110 and thus the first body 110 may be arranged on opposite ends of the bent portion 130.

Therefore, the duct 100 may extend from the second body 120 toward the second direction D2, extend in the first direction D1, extend in a direction inclined with the third direction D3 and then extend in the first direction D1 again.

It is appropriate that the bent portion 130 is formed adjacent to the lower surface 12*a* of the tub 12. This is because when the first injection unit 41 is arranged adjacent to the lower surface 12*a* of the tub 12, the first injection unit 41 may be rotated in the vicinity of the lower surface 12*a* of the tub 12.

However, the position of the bent portion 130 is not limited thereto, and thus the bent portion 130 of the duct 100 may extend directly from the second body 120 without being disposed on the first body 110.

At this time, the duct 100 may extend from the second body 120 toward the second direction D2, extend in a direction inclined with the third direction D3 and then extend in the first direction D1.

As mentioned above, because the first housing 140 and second housing 150 include the first, second and third regions 141, 142, 143, 151, 152, and 153, the duct may have a shape extending in three different directions.

Because the first housing 140 and the second housing 150 are manufactured through the injection molding method, it is possible to easily manufacture the first housing 140 and the second housing 150 having a shape extending in a plurality of directions.

The first housing 140 and the second housing 150 may include a plastic material. In addition, the first housing 140 and the second housing 150 may be formed of a material moldable using the injection molding method.

As described above, the first housing 140 may include the first body 110, the second body 120 and the bent portion 130 corresponding to the first region 141, the second region 142 and the third region 143. Further, the first housing 140 may include the hook 145 configured to be hooked to the second housing 150.

One side of the first housing 140 may include an open shape. That is, one open side of the first housing 140 may be coupled to the second housing 150 to form the duct flow path 101 of the duct 100.

An upper end of the first region 141 of the first housing 140 may include the first outlet hole 111 configured to discharge the wash water to the second injection unit 42. The first outlet hole 111 may communicate with the duct flow path 101 so that the wash water moving upward along the duct 100 may flow to the outside of the duct 100 through the first outlet hole 111.

As illustrated in FIGS. 5 to 8, the first outlet hole 111 may be formed at the upper end of the first region 141 of the first housing 140, and the docking portion 146 removably coupled to the second injection unit 42 may be formed at the upper end of the first region 141 of the first housing 140.

The second injection unit 42 may include a dock 42*b* docked to the docking portion 146 so as to allow the wash water of the duct 100 to flow into the second injection unit 42.

When the intermediate basket 52 is pulled out, the dock 42*b* may be taken out to the outside together with the second injection unit 42 and thus the docking with the docking portion 146 may be released. When the docking portion 146 is inserted into the washing chamber C again, the dock 42*b* may be inserted to the inside together with the second injection unit 42 and thus the dock 42*b* may be docked to the docking portion 146. The docking portion 146 may have a tubular shape protruding in the second direction D2. The first outlet hole 111 may be provided at an end portion of the tubular shape.

The dock 42*b* may include an accommodation portion 42*c* disposed in a direction opposite to the first direction D1 and in which the docking portion 146 is accommodated when the dock 42*b* is docked to the docking portion 146. The accommodation portion 42*c* may be provided in a tubular shape including a circumference larger than the circumference of the docking portion 146 so that the docking portion 146 may be accommodated therein.

The docking portion 146 may be inserted into the accommodation portion 42*c* to connect the duct 100 to the inside of the second injection unit 42.

An opening and closing protrusion 146*a* protruding in the second direction D2 to open and close a check valve 42*d*, which is provided inside the dock 42*b*, upon engaging with the dock 42*b*, may be provided at the end portion of the docking portion 146. When the dock 42*b* is inserted into the washing chamber C and docked to the docking portion 146, the opening and closing protrusion 146*a* may press the check valve 42*d* disposed inside the dock 42*b* so as to allow the second injection unit 42 to communicate with the duct 100.

The check valve 42*d* may be configured to open and close the communication between the inside of the second injection unit 42 and the accommodation portion 42*c*.

The check valve 42*d* prevents the wash water remaining in the second injection unit 42 from being discharged to the outside through the accommodation portion 42*c* when the second injection unit 42 is taken out together with the intermediate basket 52.

The check valve 42*d* may be configured to be opened by the opening and closing protrusion 146*a* when the second injection unit 42 is docked to the duct 100.

A sealing assembly 146*b* in which a sealing member is assembled to prevent the leakage of the water, which may occur when the accommodation portion 42*c* is docked to the docking portion 146, may be provided on an outer circumferential surface of the tubular shape of the docking portion 146.

The sealing assembly 146*b* may be provided in an annular shape along the tubular outer circumferential surface of the docking portion 146. The sealing member may be provided in a ring shape and assembled on the sealing assembly 146*b* to seal between the docking portion 146 and the accommodation portion 42*c*.

As described above, the second housing 150 may include the extension 110, the inlet portion 120, and the bent portion 130 corresponding to the first region 151, the second region 152, and the third region 153. In addition, the second housing 150 may include the hook groove 155 configured to be engaged with the hook 145.

One side of the second housing 150 may include an open shape. That is, one open side of the second housing 150 may be coupled to the open side of the first housing 140 to form the duct flow path 101 of the duct 100.

An upper end of the first region 151 of the second housing 150 may include the second outlet hole 112 configured to discharge the wash water to the third injection unit 43. The second outlet hole 112 may communicate with the duct flow path 101 so that the wash water moving upward along the duct 100 may flow to the outside of the duct 100 through the second outlet hole 112.

The second outlet hole 112 may be coupled to the upper duct 160. The wash water discharged from the second outlet hole 112 may flow to the third injection unit 43 along the upper duct 160.

The upper duct 160 is provided separately from the first housing 140 or the second housing 150 as mentioned above, but is not limited thereto. Therefore, the upper duct 160 may be formed in such a way that the upper duct 160 extends from the first housing 140 and the second housing 150 and then coupled to each other by the engagement of the hook 145 and the hook groove 155.

The second outlet hole 112 may be formed to be directed to the upper side at the upper end portion of the first region 151 of the second housing 150, and the guide 156 configured to guide the docking between the second injection unit 42 and the docking portion 146 may be formed to be directed to the front side at the upper end portion of the first region 151 of the second housing 150.

When the second injection unit 42 is taken out in the second direction D2 and then inserted in the opposite direction to the second direction D2, the guide 156 may guide the dock 42*b* so that the dock 42*b*, which moves toward the duct 100 in accordance with the second injection unit 42, is accurately docked to the docking portion 146.

Particularly, the guide 156 may be formed to have a shape protruding from the second housing 150 toward the second direction D2.

The guide 156 may be provided in a pair of protrusion shapes extending from opposite sides of the second housing 150 toward the second direction D2.

The dock 42*b* may include a guide surface 42*e* arranged on opposite sides of the dock 42*b* so as to correspond to the guide 156 and guided by the protrusion of the guide 156 provided in a pair of protrusion shape.

The guide surfaces 42*e* may extend from the opposite sides of the dock 42*b* to the third direction D3 and the direction opposite to the third direction D3, and thus the pair of the guide surface 42*a* may be provided.

The guide surface 42*e* may include an upper surface and a lower surface, and the dock 42*b* may be guided while the guide 156 is inserted into a space formed between the upper surface and the lower surface.

The upper surface of the guide surface 42*e* may be formed to be inclined upward in the opposite direction of the second direction D2, and the lower surface of the guide surface 42*e* may be formed to be inclined downward in the opposite direction of the second direction D2.

Accordingly, a distance between the upper surface and the lower surface of the guide surface 42*e* may be increased as being directed to the opposite direction of the second direction D2.

When the dock 42*b* moves in the opposite direction of the second direction D2, the guide surface 42*e* may move in the direction of the guide 156.

Because the space between the upper surface and the lower surface of the guide surface 42*e* is moved toward the guide 156, and the distance between the upper surface and the lower surface is reduced as being directed to the second direction D2 as described above, the dock 42*b* may be stably guided in the direction opposite of the second direction D2 by the guide 156 even if the guide surface 42*e* moves upward or downward.

The configuration of the guide 156 is not limited to an embodiment of the disclosure, and may be formed in the first housing 140. Alternatively, the guide 156 may be formed on both of the first housing 140 and the second housing 150.

In addition, the position of the docking portion 146 described above is not limited thereto, and thus the docking portion 146 may be formed in the second housing 150 or alternatively the docking portion 146 may be formed by the first housing 140 and the second housing 150.

The above-described configuration such as the docking portion 146, the guide 156, and the opening and closing protrusion 146*a* and the sealing assembly 146*b* which are formed in the docking portion 146 may be not be molded by the blow molding method. This is because it is difficult to perform the fine molding by using the blow molding method.

However, because the duct 100 is formed in such a way that the components formed by the injection molding method is hooked to each other as illustrated in an embodiment of the disclosure, various shapes may be easily formed by the injection molding and thus the docking portion 146, the guide 156, and the opening and closing protrusion 146*a* and the sealing assembly 146*b* which are formed in the docking portion 146 may be easily formed. Further, components having more complicated shape than the above mentioned components may be relatively easily formed.

As illustrated in FIG. 9, the second region 142 of the first housing 140 may be provided to extend in the second direction D2 as described above.

At least a part of a surface extending in the second direction D2 in the second region 142 of the first housing 140 may include a curved surface R1 to the second direction D2 from the first direction D1.

The flow of the wash water flowing in the second body 120 may be improved by the curved surface R1 of the second region 142 of the first housing 140.

The wash water flowing from the inlet hole 121 flows in the first direction D1 and the flow direction of the wash water is changed to the second direction D2 in the inside of the second body 120. In this case, the flow direction may be smoothly guided by the curved surface R1 and thus it is possible to prevent the efficiency deterioration caused by the flow rate decrease due to the collision between the second region 142 of the first housing 140 and the wash water.

The second region 152 of the second housing 150 may be provided to extend in the second direction D2 as described above.

At least a part of the surface extending in the second direction D2 in the second region 152 of the second housing 150 may include a curved surface R2 to the second direction D2 from the first direction D1.

The flow of the wash water flowing in the inlet portion 120 may be improved by the curved surface R2 of the second region 152 of the second housing 150.

The wash water flowing from the inlet hole 121 flows in the first direction D1 and the flow direction of the wash water is changed to the second direction D2 in the inlet portion 120. In this case, the flow direction may be smoothly guided by the curved surface R2 and the flow of the wash water in the duct flow path 101 inside the inlet portion 120 may be improved. When manufacturing the duct in the conventional blow molding method, it is difficult to implement a component similar to the curved surface R1 formed in the second region 142 of the first housing 140 and the curved surface R2 formed in the second region 152 of the second housing 150. However, according to an embodiment of the disclosure, it is possible to easily form the curved surface R1 formed in the second region 142 of the first housing 140 using the injection molding method and thus it is possible to precisely place the curved surface R1 to a position where the wash water the most often collides with the second region 142.

Further, it is possible to easily form the curved surface R2 formed in the second region 152 of the second housing 150 using the injection molding method and thus it is possible to place the curved surface R2 to a position where the wash water is the most easily guided in the second body 120, through the analysis.

The wash water flowing in the duct flow path 101 along the curved surfaces R1 and R2 may flow from the second body 120 to the first body 110 without pressure loss.

The second body 120 may be formed by the second region 142 of the first housing 140 and the second region 152 of the second housing 150. The inlet dock 122 of the second body 120 may extend downward from the second region 152 of the second housing 150 and be provided in a tubular shape.

The inlet dock 122 may be arranged to extend to the outside of the washing chamber C by passing through the lower surface 12*a* of the tub 12. The inlet dock 122 arranged on the outside of the washing chamber C may be connected to the second flow path 62 so that the wash water flows into the duct 100.

A portion of the second body 120 in contact with the lower surface 12*a* of the tub 12 may be arranged in the annular seal member 180 to prevent leakage of the washing chamber C.

The inlet dock 122 disposed on the outside of the washing chamber C may be coupled to a fixing member 170. The fixing member 170 may be formed in a shape of surrounding the outer circumferential surface of the inlet dock 122 having a tubular shape and fix the inlet dock 122 to the lower side of the tub 12.

A rotation protrusion 123 coupled to the coupling member 170 may be arranged on an outer circumferential surface of the inlet dock 122. The coupling member 170 may be coupled to the rotation protrusion 123 through rotation in the circumferential direction of the inlet dock 122. The coupling member 170 is coupled to the inlet dock 122 and at the same time, the coupling member 170 supports the lower end of the lower surface 12*a* of the tub 12, thereby allowing the duct 100 to be stably supported on the tub 12.

As mentioned above, the duct 100 may be formed by the engagement of the first housing 140 and the second housing 150. Accordingly, it may cause the leakage of the wash water to the outside of the duct flow path 101.

When manufacturing the duct using the blow molding method or the thermal bonding method according to the conventional manufacturing method, the leakage of the wash water to the outside of the duct may not occur. However, when two components are hooked to each other according to an embodiment of the disclosure, it may cause a difficulty in that the wash water is leaked through a minute gap between the two components.

In order to ease such a difficulty, the duct 100 according to an embodiment of the disclosure may include a first sealing surface 144 formed in the first housing 140 and a second sealing surface 154 formed in the second housing 150.

An end portion of the first sealing surface 144 and the second sealing surface 154 in the second direction D2 may be provided in a closed loop shape (refer to FIG. 4).

As illustrated in FIG. 10, the first sealing surface 144 and the second sealing surface 154 are arranged in contact with each other on the outside of the duct flow path 101 when the first housing 140 and the second housing 150 are coupled to each other. Therefore, the wash water may be prevented from leaking to the outside of the duct flow path 101.

Particularly, the first sealing surface 144 and the second sealing surface 154 are provided in the closed loop shape on more outer side than a region forming the duct flow path 101, in the first housing 140 and the second housing 150.

Accordingly, when the first housing 140 and the second housing 150 are coupled to each other, the first sealing surface 144 and the second sealing surface 154 may be in contact with each other on the outside of the duct flow path 101 and in the third direction D3 and in the opposite direction of the third direction D3 about the duct flow path 101.

The second housing 150 may include a coupling protrusion 157 protruding toward the second direction D2 and provided in a closed loop shape with respect to the second direction D2.

The first housing 140 may include a coupling portion 147 including a coupling groove 147*a* into which the coupling protrusion 157 is inserted in the opposite direction of the second direction D2.

The coupling portion 147 may include a first wall 148 and a second wall 149 protruding in the opposite direction of the second direction D2 to form the concave coupling groove 147*a* in the second direction D2. The coupling groove 147*a* may be provided as a space formed between the first wall 148 and the second wall 149. The second wall 149 may be formed to be more adjacent to the duct flow path 101 than the first wall 148.

When the first housing 140 is coupled to the second housing 150, the coupling protrusion 157 may be inserted into the coupling groove 147*a* to be coupled to the coupling portion 147.

When the coupling protrusion 157 is coupled to the coupling portion 147, an inner surface of the coupling protrusion 157 may be in contact with an outer surface of the second wall 149 and an outer surface of the coupling protrusion 157 may be in contact with an inner surface of the first wall 148.

The first sealing surface 144 may be provided to be arranged on the outer surface of the second wall 149 and the second sealing surface 154 may be provided to be arranged on the inner surface of the coupling protrusion 157.

Accordingly, when the coupling protrusion 157 is coupled to the coupling portion 147, the first sealing surface 144 and the second sealing surface 154 may be in contact with each other to seal the duct flow path 101.

As mentioned above, the outer surface of the second wall 149 may be formed by the second sealing surface 154 and the inner surface 149*a* of the second wall 149 may form at least a part of the duct flow path 101.

In addition, the inner surface of the first wall 148 may be arranged in contact with the coupling protrusion 157 and the hook 145 may be disposed on the outer surface of the first wall 148.

As mentioned above, the first sealing surface 144 and the second sealing surface 154 may be arranged on the outside of the duct flow path 101 in the third direction D3 and in the opposite direction of the third direction D3 about the duct flow path 101, respectively.

Accordingly, when the wash water flows into the duct flow path 101, the duct flow path 101 may be pressurized to the outside of the duct flow path 101 by the pressure of the wash water. At this time, the duct flow path 101 may be pressed in the third direction D3 and in the opposite direction of the third direction D3 and thus the first sealing surface 144 and the second sealing surface 154 may be pressed toward a direction, in which the first sealing surface 144 and the second sealing surface 154 face to each other, by the duct flow path 101.

Therefore, the welding force in the direction in which the first sealing surface 144 and the second sealing surface 145 are in contact with each other may increase, and thus the sealing against the duct flow path 101 may be more effectively performed.

As described above, the duct 100 according to an embodiment of the disclosure may include a shape extending in the first direction D1, the second direction D2, and the third direction D3.

Accordingly, in order to completely seal the duct flow path 101 of the duct 100, the first sealing surface 144 and the second sealing surface 145 may be required to extend in at least two directions.

Further, as described above, because the first sealing surface 144 and the second sealing surface 145 are required to be in a closed loop shape with respect to the second direction D2, the shape of the first sealing surface 144 and the second sealing surface 145 may be important to seal the duct flow path 101 in the three dimensions.

Accordingly, as shown in FIGS. 11 and 12, in a first section 144*a* of the first sealing surface 144 arranged on the first region 141 and the third region 143 of the first housing 140, the first sealing surface 144 may be arranged to face in the third direction D3 and the opposite direction of the third direction D3. In a second section 144*b* of the first sealing surface 144 arranged on the second region 142, the first sealing surface 144 may be arranged to face the opposite direction of the first direction D1.

Because an extension direction of the first sealing surface 144 is changed between the first section 144*a* of the first sealing surface 144 and the second section 144*b* of the first sealing surface 144, the first sealing surface 144 may include a curved shape connecting the first section 144*a* to the second section 144*b*. It is appropriate that the curved surface of the first sealing surface 144 may be formed inside of the inlet portion 120.

In a first section 154*a* of the second sealing surface 154 arranged on the first region 151 and the third region 153 of the second housing 150, the second sealing surface 154 may be arranged to face in the third direction D3 and the opposite direction of the third direction D3. In a second section 154*b* of the second sealing surface 154 arranged on the second region 152, the second sealing surface 154 may be arranged to face the first direction D1.

Because an extension direction of the second sealing surface 154 is changed between the first section 154*a* of the second sealing surface 154 and the second section 154*b* of the second sealing surface 154, the second sealing surface 154 may include a curved shape connecting the first section 154*a* to the second section 154*b*. It is appropriate that the curved surface of the second sealing surface 154 may be formed inside of the inlet portion 120. Further, the curved surface of the second sealing surface 154 may be formed to correspond to the curved surface of the first sealing surface 144.

Accordingly, because the first sealing surface 144 and the second sealing surface 154 include the first sections 144*a* and 154*a* and the second sections 144*b* and 154*b*, respectively, it is possible to easily seal the duct flow path 101 in the three dimensions.

The first sections 144*a* and 154*a* of the first sealing surface 144 and the second sealing surface 154 may be arranged in contact with each other in the third direction D3.

The second sections 144*b* and 154*b* of the first sealing surface 144 and the second sealing surface 154 may be arranged in contact with each other in the first direction D1.

Therefore, even though the duct 100 includes the shape of the second body 120, the first body 110, and the bent portion 130, the first sealing surface 144 and the second sealing surface 145 may relatively sufficiently prevent the wash water from leaking from the duct flow path 101.

Hereinafter a duct 300 of a dishwasher 1 according to another embodiment of the disclosure will be described. The configuration other than the configuration of the duct 300 described below is the same as the configuration of the above-described embodiment and similar description thereof will be omitted.

Figure 13:
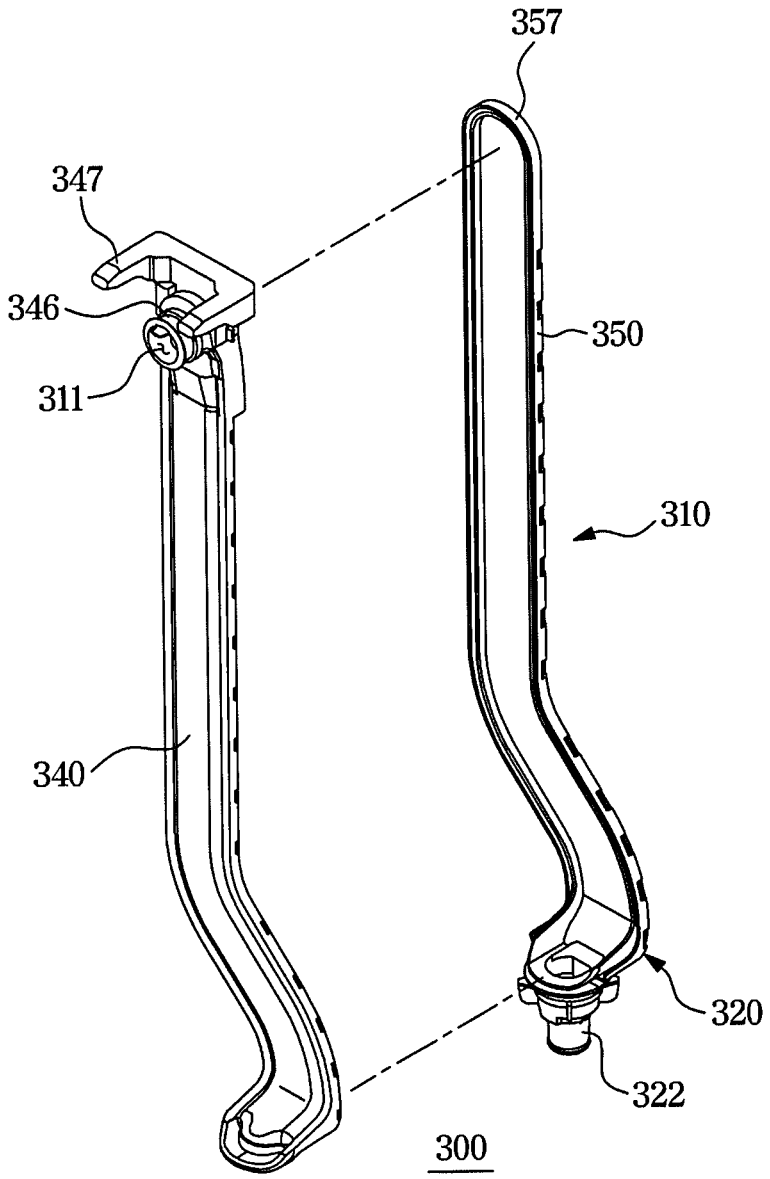
FIG. 13 is an exploded perspective view of a duct of a dishwasher according to another embodiment of the disclosure.

FIG. 13 is an exploded perspective view of a duct of a dishwasher according to another embodiment of the disclosure.

The duct 300 may be formed through a hook engagement between a first housing 340 and a second housing 350.

The duct 300 may include an extension 310 extending in a first direction D1 facing upward in the height direction of the dishwasher 1. Wash water pumped from a circulation pump 30 disposed below a washing chamber C may be moved upward through the extension 310 to flow to a second injection unit 52.

The extension 310 may include an outlet hole 311 configured to discharge wash water flowing upward along the extension 310. The wash water discharged through the outlet hole 311 may move to the second injection unit 42.

The first housing 340 may include a docking portion 346 in which the outlet hole 311 is arranged and to which the second injection unit 42 is docked. Further the first housing 340 may include a guide 347 configured to guide docking between the second injection unit 42 and a docking portion 346.

The dishwasher 1 according to another embodiment of the disclosure may not include a third injection unit unlike the dishwasher 1 according to an embodiment of the disclosure. Accordingly, the wash water flowing through the duct 300 may flow only to the second injection unit 42.

Accordingly, the second housing 350 does not include a second outlet hole 112, unlike the second housing 150 according to an embodiment of the disclosure.

An upper end of the second housing 350 may include an upper portion 357 closed to seal the upper end of the duct 300.

An inlet portion 320 of the duct 300 may include an inlet dock 322 including an inlet hole. The inlet dock 322 may be arranged below the second housing 350. However, the position of the inlet dock is not limited thereto, and thus the inlet dock 322 may be formed in the first housing 340.

Hereinafter a duct 400 of a dishwasher 1 according to still another embodiment of the disclosure will be described. The configuration other than the configuration of the duct 400 described below is the same as the configuration of the above-described embodiment and similar description thereof will be omitted.

Figure 14:
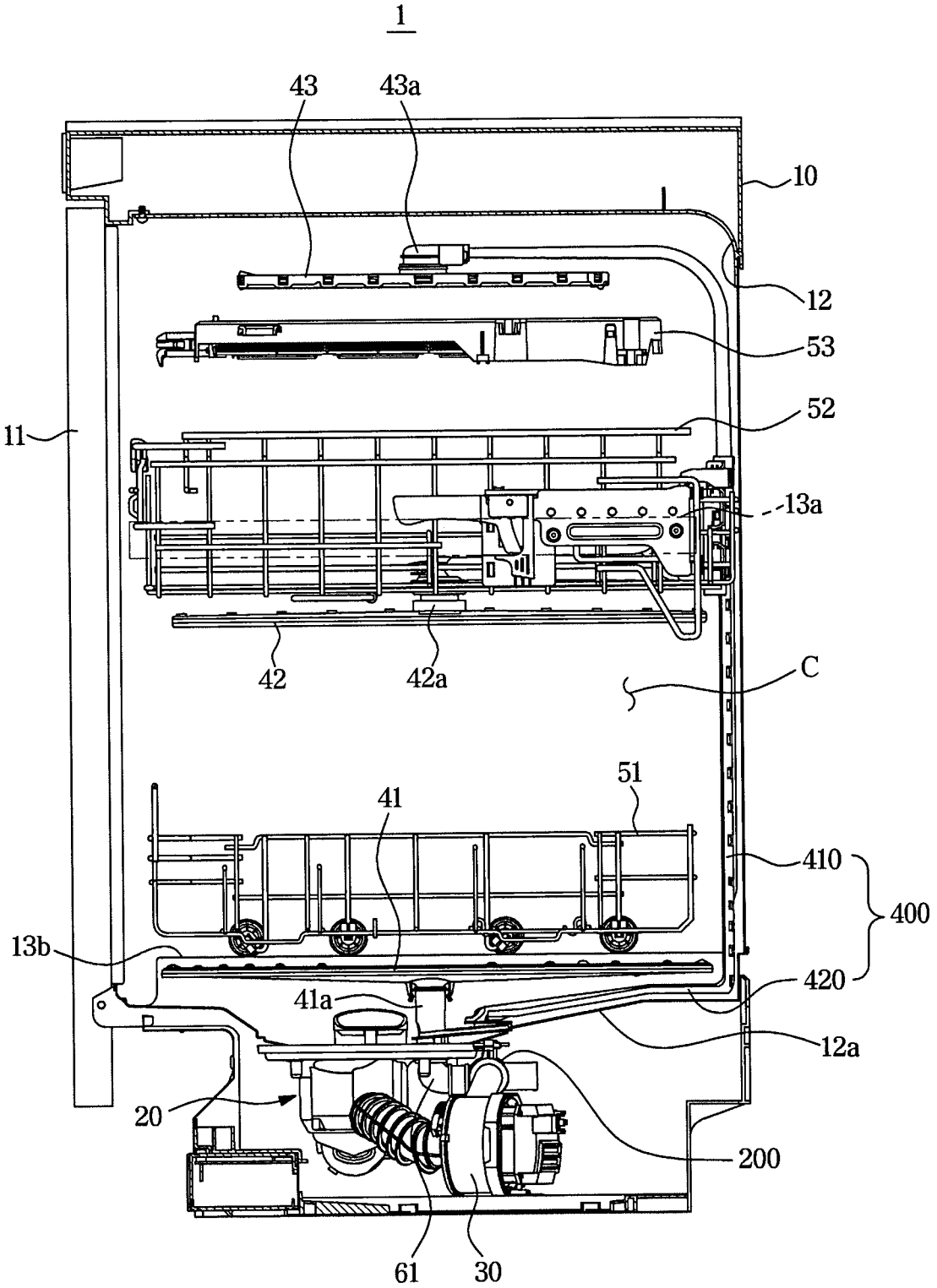
FIG. 14 is a cross-sectional view of a dishwasher according to still another embodiment of the disclosure.

FIG. 14 is a cross-sectional view of a dishwasher according to still another embodiment of the disclosure The duct 400 may be formed through a hook engagement between a first housing and a second housing.

The duct 400 may include an extension 410 extending in a first direction D1 facing upward in the height direction of the dishwasher 1 and an inlet portion 420 extending in a second direction D2.

The inlet portion 420 is a space into which wash water flows into the duct 400. One end of the inlet portion 420 may be connected to the extension 410, and the other end of the inlet portion 420 extending from the one end toward the second direction D2 may be arranged inside a sump 20.

When the other end of the inlet portion 420 is arranged on one side of a tub 120, the wash water may be leaked to the outside of the tub 120. In order to prevent this, the other end of the inlet portion 420 may be arranged inside the sump 20 to minimize leakage from the duct 400.

As is apparent from the above description, as for the duct having the shape extending in at least two directions, because the duct is manufactured by a method in which the plurality of component is hooked to each other, it is possible to freely form the shape of the duct, and the manufacture of the duct may be relatively simplified than the manufacture of the duct performed by the blow molding method.

Although a few embodiments of the disclosure have been shown and described, it would be appreciated by those skilled in the art that changes may be made in these embodiments without departing from the principles and spirit of the disclosure, the scope of which is defined in the claims and their equivalents.

| Description of symbols | |
|---|---|
| 1: dishwasher | 10: main body |
| 11: door | 12: tub |
| 20: sump | 30: circulation pump |
| 41: first injection unit | 42: second injection unit |
| 43: third injection unit | 51: lower basket |
| 52: intermediate basket | 53: upper basket |
| 100: duct | 101: duct flow path |
| 110: extension | 120: inlet portion |
| 130: curved portion | 140: first housing |
| 144: first sealing surface | 145: hook |
| 150: second housing | 154: second sealing surface |
| 155: hook groove | 160: upper duct |

What is claimed is:

1. A dishwasher comprising:

a main body;

a tub configured to be inside the main body;

a basket configured to be inside the tub to receive an item to be washed;

an injection assembly configured to spray water toward the basket; and a duct including:

a first body which extends in a first direction and configured to supply the water to the injection assembly, and a second body through which the water flows, the second body extends from the first body along a second direction, wherein the duct is formed by coupling a hook, formed to protrude from a surface of a first housing onto a hook groove formed on a second housing, the first housing forming a portion of the first body and a portion of the second body, and the second housing forming another portion of the first body and another portion of the second body.

2. The dishwasher of claim 1, wherein the duct further includes a flow path inside the first body and the second body, the duct having a width extending along a third direction, the first housing extends along the third direction to form at least a portion of the flow path, and the second housing extends along the third direction to form another portion of the flow path.

3. The dishwasher of claim 2, wherein the first housing includes a first sealing surface and the second housing includes a second sealing surface, the first sealing surface and the second sealing surface being in contact while the first housing and the second housing are coupled together, wherein the first sealing surface and the second sealing surface are provided in the first body to face each other along the second direction while being provided in the second body to face each other along the third direction perpendicular to the first direction, and an end portion of the first sealing surface and an end portion of the second sealing surface are provided in a closed loop shape with respect to the second direction, respectively.

4. The dishwasher of claim 3, wherein the hook is arranged on the outside of the first sealing surface and configured to hook onto the hook groove.

5. The dishwasher of claim 4, wherein the hook groove is arranged on the outside of the second sealing surface and configured to be engaged with the hook.

6. The dishwasher of claim 2, wherein the first body further comprises a bent portion configured to allow the duct to be bent along the third direction perpendicular to the second direction.

7. The dishwasher of claim 1, wherein the hook of the first housing is configured to hook onto the hook groove of the second housing along the first direction.

8. The dishwasher of claim 1, wherein the first housing further comprises a first curved surface arranged in the second body so as to guide the water to the first body.

9. The dishwasher of claim 1, wherein the second housing further comprises a second curved surface arranged in the second body so as to guide the water to the first body.

10. The dishwasher of claim 1, wherein the second housing comprises an inlet configured to allow the water to flow to the inside of the duct.

11. The dishwasher of claim 1, wherein the first housing comprises an outlet configured to supply the water to the injection assembly.

12. The dishwasher of claim 11, wherein the injection assembly comprises an intermediate rotor arranged on a center of the inside of the tub and an upper rotor arranged on an upper portion of the inside of the tub, the outlet is connected to the intermediate rotor, and the second housing comprises an auxiliary outlet configured to supply the water to the upper rotor.

13. The dishwasher of claim 12, wherein the duct further comprises an upper duct configured to connect the auxiliary outlet and the upper rotor.

14. The dishwasher of claim 12, wherein the first housing further comprises a guide provided to protrude along the first direction to guide coupling of the intermediate rotor and the outlet.

15. The dishwasher of claim 14, wherein the outlet and the guide are integrally formed with the first housing.

16. A dishwasher comprising:

a main body;

a tub configured to be inside the main body;

a basket configured to be inside the tub to receive an item to be washed;

an injection assembly configured to spray water toward the basket; and a duct formed by coupling a hook, formed to protrude from a surface of a first housing, onto a hook groove of a second housing, the duct configured to supply the water to the injection assembly, wherein the first housing includes an outlet configured to supply the water to the injection assembly, and the second housing includes an inlet configured to allow the water to flow to the inside of the duct.

17. The dishwasher of 16, wherein the duct further comprises:

a first body which extends along a first direction, a second body which extends from the first body along a second direction, and a flow path having a width which extends along a third direction perpendicular to the first direction and the second direction, wherein the first housing is formed along the first direction, the second direction and the third direction to form at least a portion of the first body, the second body, and the flow path, and the second housing is formed along the first direction, the second direction and the third direction to form another portion of the first body, the second body, and the flow path.

18. The dishwasher of claim 16, wherein the second housing comprises a coupling protrusion protruding in a closed loop shape to seal the flow path, and the first housing comprises a coupling portion to which the coupling protrusion is inserted, wherein an inner surface of the coupling protrusion comprises a first sealing surface in contact with the coupling portion, and the coupling portion comprises a second sealing surface in contact with the first sealing surface to seal the flow path.

19. A duct of a dishwasher, the duct comprising:

an outlet configured to supply water to an injection assembly configured to spray the water;

an inlet to which the water flows;

a first housing in which the outlet is arranged, and provided to extend in at least three directions perpendicular to each other, the first housing having a hook formed to protrude from a surface of the first housing; and a second housing in which the inlet is arranged and the second housing having a hook groove, wherein the duct is formed by coupling the hook of the first housing onto the hook groove of a second housing.

* * * * *